US005217055A

United States Patent [19]

Butler

[11] Patent Number: 5,217,055

[45] Date of Patent: Jun. 8, 1993

[54] PORTABLE JOINTER TABLE

[76] Inventor: Michael J. Butler, 15 Thompson St., Pembroke, Mass. 02359

[21] Appl. No.: 876,742

[22] Filed: Apr. 27, 1992

[51] Int. Cl.[5] ..... B27C 1/00

[52] U.S. Cl. ..... 144/117 R; 83/574; 144/1 E; 144/129; 144/251 R; 144/253 R; 144/253 G; 144/286 R

[58] Field of Search ..... 144/114 R, 117 R, 129, 144/286 R, 1 R, 1 E, 1 F, 251 R, 251 A, 251 B, 253 R, 253 G; 83/574

[56] References Cited

U.S. PATENT DOCUMENTS

| | | | |
|---|---|---|---|
| 4,350,193 | 9/1982 | McCambridge et al. | 144/286 R |
| 4,483,573 | 11/1984 | Keller | 144/286 R |
| 4,774,986 | 10/1988 | LaGra | 144/286 R |
| 5,022,447 | 6/1991 | Monobe | 144/129 |
| 5,092,379 | 3/1992 | Stallings | 144/286 R |

*Primary Examiner*—W. Donald Bray
*Attorney, Agent, or Firm*—John P. McGonagle

[57] ABSTRACT

A table with means for installation of an electric planer therein so that the planer cutting blades engage a workpiece placed upon the table. An adjustable guide fence is also provided with the table for guiding workpieces over the cutting blades of the planer.

17 Claims, 5 Drawing Sheets

PORTABLE JOINTER TABLE

BACKGROUND OF THE INVENTION

This invention relates to woodworking, and more particularly to a table for converting a conventional electric planer to a portable longbed jointer.

Jointer planes are planes for truing the edges of boards, planning large surfaces, etc. Jointer planes are typically integrated with a table designed for and having a surface area large enough to support boards, etc. The integrated jointer plane and table configuration is then conventionally termed a "jointer". Jointers are expensive, heavy, and difficult to move from one location to another.

It is therefore, an objective of the present invention to provide an inexpensive jointer which is also reasonably lightweight and easy to move from one location to another.

SUMMARY OF THE INVENTION

In view of the foregoing disadvantages inherent in the known types of devices now present in the prior art, the present invention provides a portable jointer table. The general purpose of the present invention, which will be described subsequently in greater detail, is to quickly convert an electric planer into a portable longbed jointer.

To attain this, the present invention provides a table with means for installation of an electric planer therein. An adjustable guide fence is also provided with the table for guiding workpieces over the cutting blades of the planer. Since most woodworkers already own an electric planer, purchase of the table of the instant invention provides a means of owning a longbed jointer for very little additional cost.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
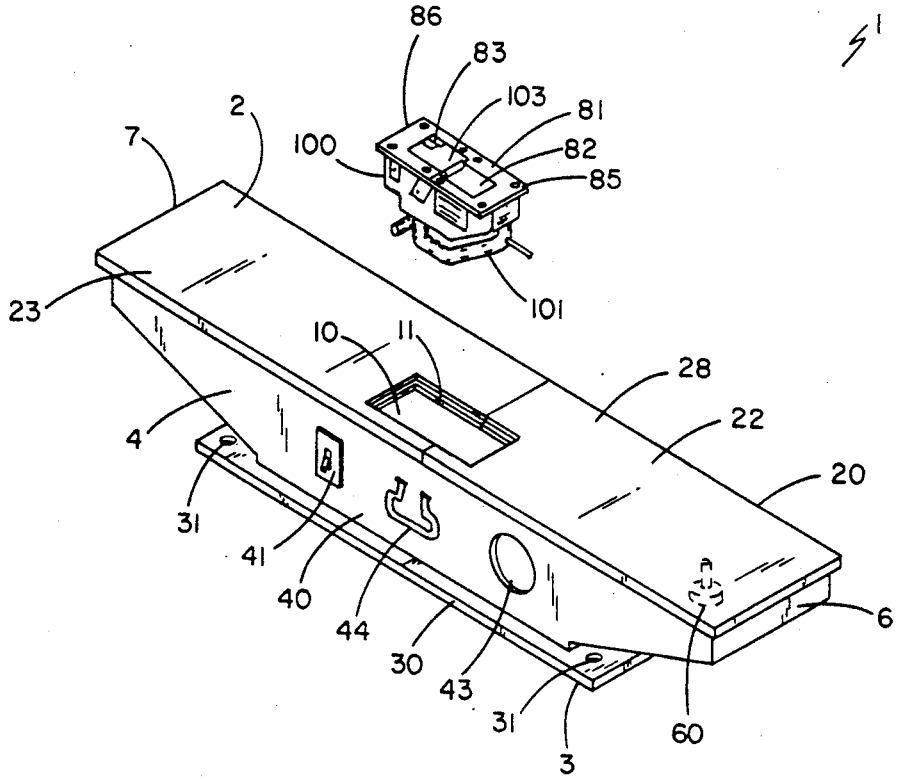
FIG. 1 is a front perspective view of a jointer table, without blade guard or fence, constructed according to the principles of the present invention.
Figure 2:
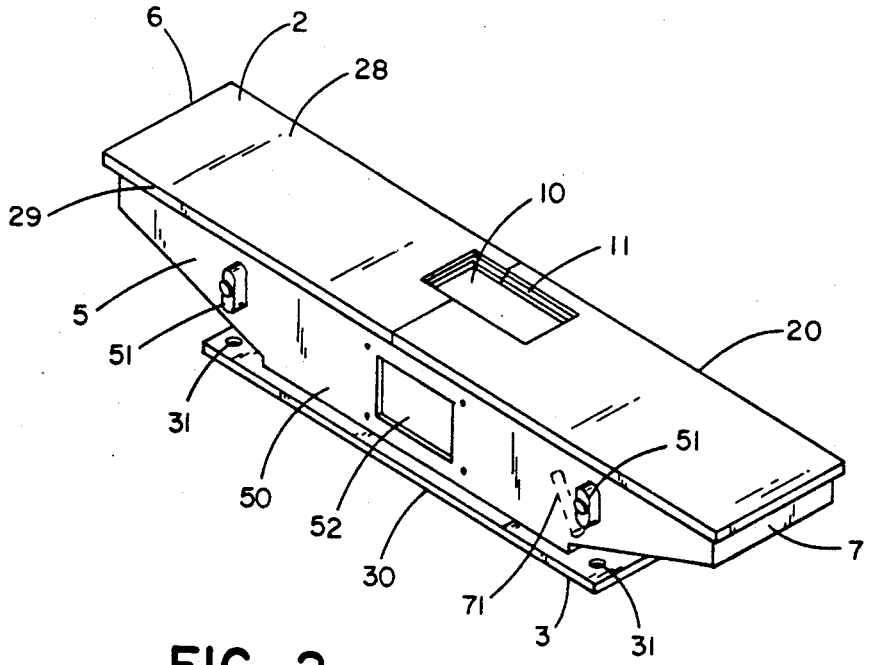
FIG. 2 is a rear perspective view thereof.

Referring to the drawings in detail wherein like elements are indicated by like numerals, there is shown a portable jointer table 1 constructed according to the principles of the present invention. The table has a top 2, bottom 3, front 4, back 5, infeed end 6 and outfeed end 7. A workpiece (not shown) is fed across the table top 2 from the infeed end 6 to the outfeed end 7. The table 1 is used in conjunction with an electric planer 100 to provide a woodworker with a table type jointer which can be transported from place to place. The table 1 is designed to plane boards as long as 192 inches in length. The table 1 is preferably made of cast aluminum, but may also be made of any other sturdy, stable material, including wood.

The table top 20 has a generally rectangular shape with a longitudinal axis running from infeed end 6 to outfeed end 7. In this embodiment of the invention the top 20 is 72 inches long and 12 inches wide. The table top 20 has a generally rectangular opening 10 centrally positioned and having a longitudinal axis coincidental with the table top longitudinal axis. The opening 10 may contains an interior radial holding flange 11. In an optional embodiment the opening 10 may be bevelled. The purpose of the flange 11 (or bevel) is to hold a planer plate 80 which is discussed further below. The planer plate 80 has an outline approximately equal to the table top opening 10 and is divided into two major sections 85, 86. When the planer plate 80 is inserted into the table top opening 10, the flange 11 holds the plate 80 from dropping through the top 20. After insertion the planer plate's upper surface 81 is flush with the table top upper surface 28. A guide fence 90 is adjustably attached to the table top 20 and provides support and guidance to the workpiece being planed. A conventional blade guard 15 is pivotally attached to the front side 4 of the table top 20 to provide protection from the planer blades when not engaging a workpiece.

The electric planer 100 has a handle portion 101 and table portion 102 containing cutting blades. The planer plate 80 has a stenciled opening 82 corresponding to the planer's table portion 102 outline. The planer plate opening 82 is beveled or contains an interior radial holding flange 83. The planer 100 is inverted and inserted into the planer plate's opening 82 from the top surface 81 handle side 101 first. The flange 83 holds the planer table portion 102 and prevents the planer 100 from falling through the planer plate stencil opening 82. Some planers would be bolted directly to the plate 80. The planer 100 fits into the planer plate 80 so that the cutting blades 103 are nearly flush with the planer plate upper surface 81. The use of planer plates 80 provides the ability to use the same table 1 regardless of the planer used. Since many planer manufacturers use different planer tables 102, a planer plate 80 specific for an individual manufacturer's planer 100 would be provided with the table 1. The planer plate 80 may be omitted, provided that the planer 100 used would fit into the table top opening 10 without falling through.

Figure 6:
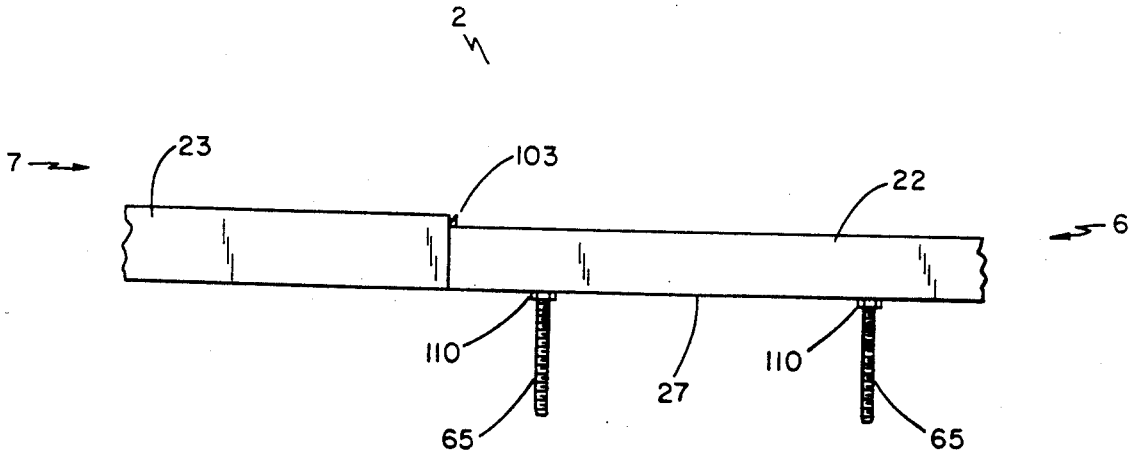
FIG. 6 is a front view thereof, partly in section.
Figure 7A:
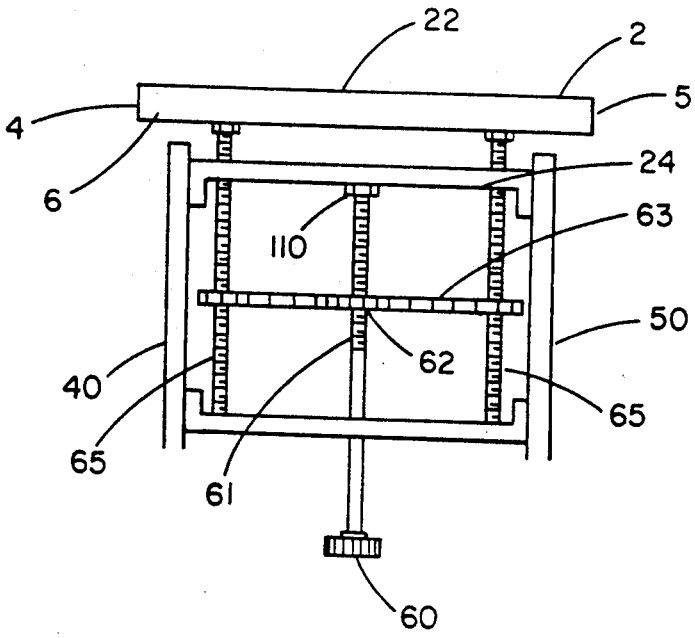
FIG. 7A is a right side view of the table of the present invention, partly in section.
Figure 7B:
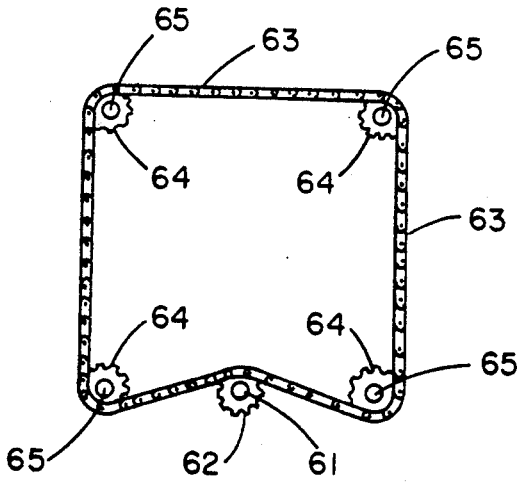
FIG. 7B is a top plan view of the table top height adjustment mechanism of FIG. 7A.
Figure 8:
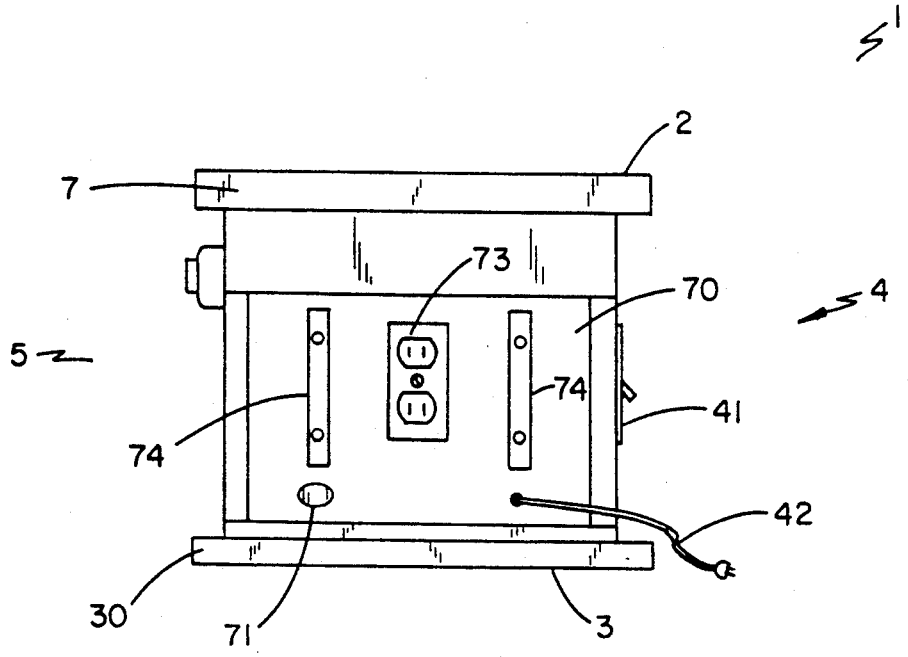
FIG. 8 is a left side view thereof.
Figure 9:
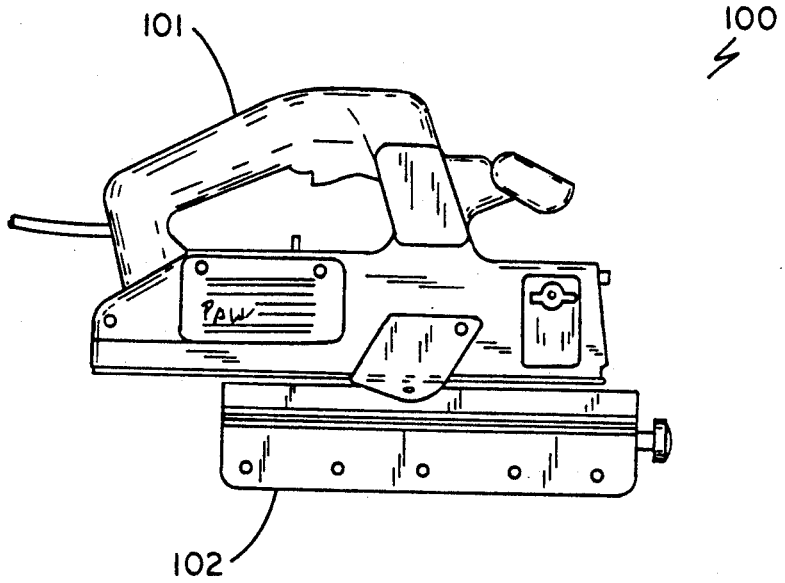
FIG. 9 is a side of an electric planer.

The table top 20 has a two-piece construction. This may be most clearly seen in FIG. 6. The table top 20 is comprised of an infeed plate element 22 and an outfeed plate element 23. The outfeed plate element 23 is fixedly attached to the underlying table structure. The infeed plate element 22 is adjustably attached to the underlying table structure. As may be best understood from FIGS. 7A and 7B, an adjustment knob 60 is attached to a vertical, threaded rod 61 which threadingly engages a gear 62. The rod 61 terminates in a junction ring 110 fixedly attached to a transverse bracket 24 fixedly attached to the front and back side structures 40, 50. The gear 62 engages a horizontal gear chain loop 63. The loop 63 engages four lifting gears 64 threadingly engaging four vertical lifting rods 65 terminating in junction rings 110 attached to the undersurface 27 of the infeed plate element 22. By rotating the knob 60 the infeed plate element 22 may be raised or lowered depending upon the desired depth of cut. This is in addition to the normal blade adjustments in the planer 100 itself.

Figure 3:
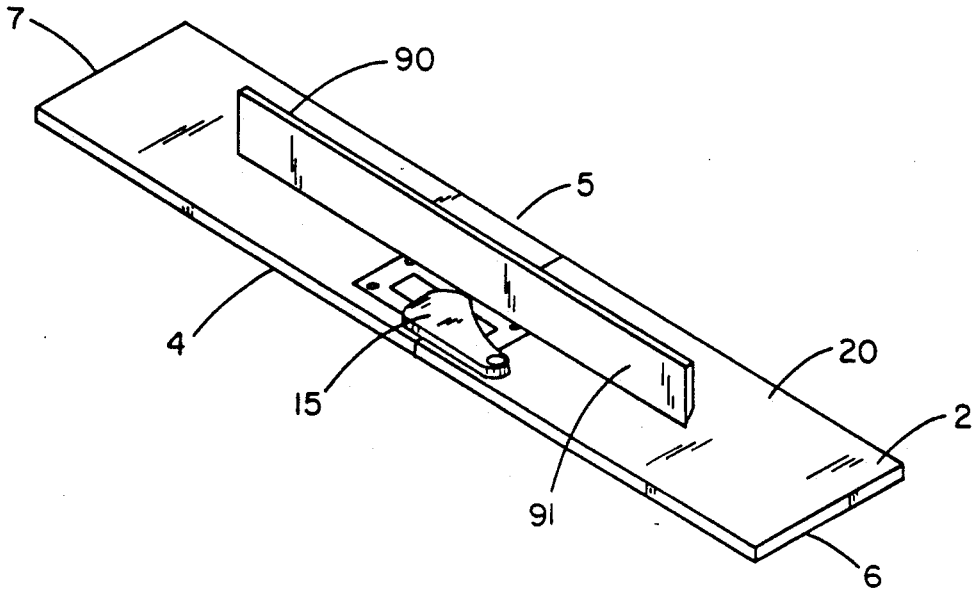
FIG. 3 is a top front perspective view of the table top thereof.
Figure 4:
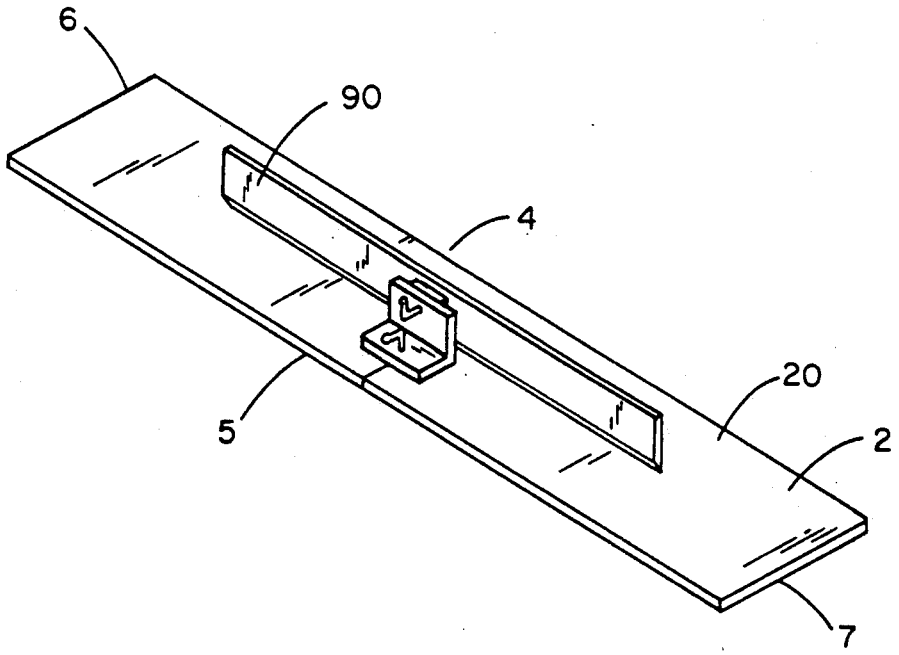
FIG. 4 is a top rear perspective view thereof without the table top opening shown.
Figure 5:
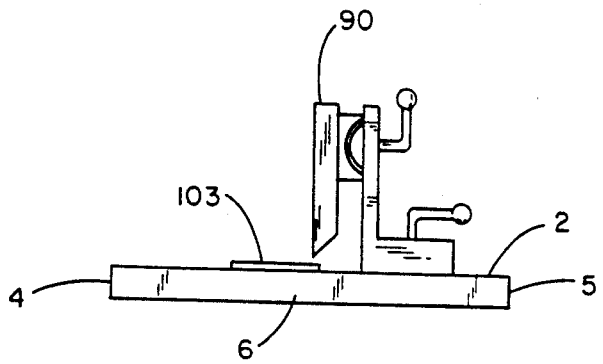
FIG. 5 is a side view thereof.

The guide fence 90, illustrated in detail in FIGS. 3-5, is forty inches long with a longitudinal axis coincidental with the longitudinal axis of the table top 2. The fence 90 has a height of 6 inches and is normally positioned 4 inches in from the table top back side 5. This position is adjustable. The fence front surface 91 is angularly adjustable through a vertical axis perpendicular to the longitudinal axis of the fence from 45 degrees to 90 degrees with positive stops set at 45 degrees and 90 degrees. The fence 90 is also pivotally adjustable in a horizontal plane about its midpoint.

The bottom 3 of the table 1 is comprised of a flat, generally rectangular base member 30. The base 30 has four corner holes 31 formed therein for mounting the table 1 to horses or other structures. The holes 31 may also be used for bolts (not shown) to attach folding legs (not shown) to the base 30. The table has front 40, back 50, and end feed 70 side structures interconnecting the table top 2 with the base 30. Interior solid bridging is attached to the base 30 and top 2 to provide additional support to the table top 2. The height of the table 1 in this embodiment is 12 inches. The base 30 is approximately half as long as the top upper surface 20. The front 40 and back 50 side structures vertically taper down from the top 20 to the base 30.

The front side structure 40 has an on/off switch 41 providing power from an external source via a power cord 42 to an outlet 73 mounted on the outfeed end side structure 70. The cord (not shown) from the electric planer 100 is passed from the table interior through a cylindrical, hollow cord chute 71 attached to the solid bridging and terminating at the outfeed end side structure 70. Excess cord would be rapped around cord brackets mounted onto the end feed side 70. The planer cord would be plugged into the outlet 73 and power to the planer 100 controlled from the on/off switch 41 on the front side structure 40.

The front side structure 40 has an opening 43 formed therein to provide access to the planer 100 for various desired adjustments. The front side structure 40 also has a sturdy handle 44 attached thereto. This provides a means for carrying the table 1 from one location to another.

The back side structure 50 has two protective "feet" 51 mounted thereon. The feet 51 protect the table top edge 29 and keep the table 1 balanced when put down by the handle 44. The back side structure 50 also has a saw dust exhaust chute opening 52 formed therein for rear sawdust discharge.

It is understood that the above-described embodiment is merely illustrative of the application. Other embodiments may be readily devised by those skilled in the art which will embody the principles of the invention and fall within the spirit and scope thereof.

I claim:

1. A portable jointer table for planing a workpiece, comprising:

a generally rectangular table having a top, bottom, front, back, infeed end and outfeed end, and having a longitudinal axis running from infeed end to outfeed end, said table top having a generally rectangular opening centrally positioned and having a longitudinal axis coincidental with the table top longitudinal axis;

an electric planer with a power cord and having a handle portion and a table portion, said planer being inverted and fitted into said opening from the top surface handle portion first; and a guide fence adjustably attached to the table top to provide support and guidance to the workpiece being planed.

2. A portable jointer table as recited in claim 1, wherein:

said opening contains an interior radial holding flange.

3. A portable jointer table as recited in claim 2, further comprising:

a planer plate having an outline approximately equal to the table top opening inserted into said opening.

4. A portable jointer table as recited in claim 3, wherein:

said planer plate has a stenciled opening corresponding to the planer's table portion outline, said planer plate opening being beveled or containing an interior radial holding flange, wherein said planer is inverted and inserted into the planer plate's opening handle portion first.

5. A portable jointer table as recited in claim 4, wherein:

said planer fits into the planer plate so that the cutting blades are nearly flush with the planer plate upper surface.

6. A portable jointer table as recited in claim 5, wherein:

said table top has a two-pieced construction comprised of an infeed plate element and an outfeed plate element.

7. A portable jointer table as recited in claim 6, wherein:

said outfeed plate element is fixedly attached to the underlying table structure; and said infeed plate element is adjustably attached to the underlying table structure, wherein said infeed plate element may be horizontally raised or lowered with respect to said outfeed plate element.

8. A portable jointer table as recited in claim 7, further comprising:

a vertical, threaded adjustment rod the lower end of which terminates in an adjustment knob and the upper end of which terminates in a junction ring fixedly attached to a transverse bracket fixedly attached to the front and back side table structures;

a gear radially attached to said adjustment rod;

a horizontal gear chain loop threadingly engaging said gear;

four lifting gears threadingly engaged by said chain loop and threadingly engaging four vertical lifting rods terminating in junction rings attached to the undersurface of said infeed plate element;

wherein rotation of said adjustment knob causes said infeed plate element to be raised or lowered.

9. A portable jointer table as recited in claim 8, wherein:

said table bottom is comprised of a flat, generally rectangular base member having corner holes formed therein.

10. A portable jointer table as recited in claim 9, wherein:

said table has front, back, and end feed side structures interconnecting the table top with the base.

11. A portable jointer table as recited in claim 10, further comprising:

interior solid bridging attached to the base and top provide additional support to the table top.

12. A portable jointer table as recited in claim 11, wherein:

said guide fence has a longitudinal axis coincidental with the longitudinal axis of the table top, and a front surface angularly adjustable through a vertical axis perpendicular to the longitudinal axis of the fence from 45 degrees to 90 degrees with positive stops set at 45 degrees and 90 degrees, and means for pivotal adjustment in a horizontal plane about the fence midpoint.

13. A portable jointer table as recited in claim 12, wherein:

said front side structure has an on/off switch providing power from an external source via a power cord to an outlet mounted on the outfeed end side structure.

14. A portable jointer table as recited in claim 13, wherein:

said cord from the electric planer is passed from the table interior through a cylindrical, hollow cord chute attached to the solid bridging and terminating at the outfeed end side structure, said planer cord being then plugged into the outlet and power to the planer controlled from the on/off switch on the front side structure.

15. A portable jointer table as recited in claim 14, further comprising:

a handle attached to said front side structure; and two protective feet elements mounted on said back side structure.

16. A portable jointer table as recited in claim 15, further comprising:

a sawdust exhaust chute on said back side structure for sawdust discharge.

17. A portable jointer table as recited in claim 16, further comprising:

a blade guard pivotally attached to the front side of the infeed table to provide protection from the planer blades when not engaging a workpiece.

* * * * *